United States Patent [19]

Gaget et al.

[11] 4,349,489

[45] Sep. 14, 1982

[54] JET FOR THE PRODUCTION OF A VAPORIZED IDLING MIXTURE IN AN INTERNAL COMBUSTION ENGINE

[75] Inventors: Alain Gaget, Bonnecoste-Cales, 46200 Souiliac, France; Guy Juillot, Malmort, France

[73] Assignee: Alain Gaget, Souiliac, France

[21] Appl. No.: 247,717

[22] PCT Filed: Jun. 16, 1980

[86] PCT No.: PCT/FR80/00095

§ 371 Date: Mar. 26, 1981

§ 102(e) Date: Mar. 26, 1981

[87] PCT Pub. No.: WO81/00281

PCT Pub. Date: Feb. 5, 1981

[30] Foreign Application Priority Data

Jul. 26, 1979 [FR] France ..... 79 19281

[51] Int. Cl.[3] ..... F02M 3/08

[52] U.S. Cl. ..... 261/41 D; 261/DIG. 38; 261/121 B

[58] Field of Search ..... 261/41 D, DIG. 38, 121 B

[56] References Cited

U.S. PATENT DOCUMENTS

| | | | |
|---|---|---|---|
| 2,962,269 | 11/1960 | Stanton | 261/41 D |
| 3,313,532 | 4/1967 | Carlson et al. | 261/41 D |
| 3,408,054 | 10/1968 | Walker | 261/41 D |
| 3,503,594 | 3/1970 | Goto | 261/41 D |
| 3,952,076 | 4/1976 | Chatelain | 261/41 D |
| 4,075,296 | 2/1978 | Orsini et al. | 261/41 D |
| 4,146,594 | 3/1979 | Raud | 261/41 D |

FOREIGN PATENT DOCUMENTS

| | | | |
|---|---|---|---|
| 2450952 | 3/1979 | France | 261/41 D |
| 2425554 | 7/1979 | France | 261/41 D |

*Primary Examiner*—Tim R. Miles

*Attorney, Agent, or Firm*—Shlesinger, Arkwright, Garvey & Dinsmore

[57] ABSTRACT

This invention relates to a process and a jet to produce an idling vaporized mixture in an internal combustion engine. The process consists in vaporizing the mixture in two phases: one premixing phase in a turbulence chamber (10) consisting of mixing the fuel flow $C_r$ with an auxiliary air flow $A_a$, which is in a lower proportion to the idling air flow $A_r$, to obtain a highly vaporized premixture, and a final mixing phase made in a second chamber, known as the mixing chamber (5) and consisting of mixing the premixture $M_p$ with the slow-running air flow $A_r$. A needle is responsive to changes in the vacuum level and enables the flow rate of the fuel to be adjusted as a function of the engine speed.

4 Claims, 5 Drawing Figures

Figure 1:
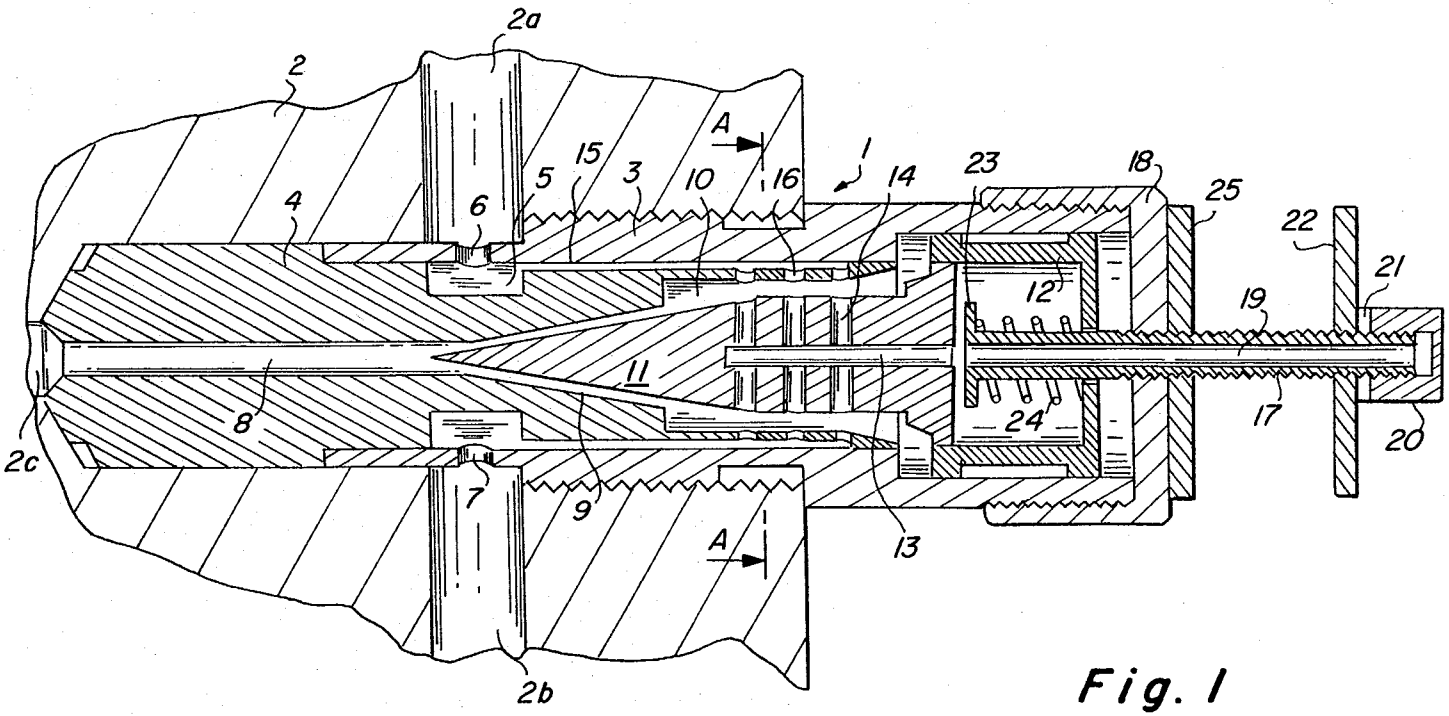

JET FOR THE PRODUCTION OF A VAPORIZED IDLING MIXTURE IN AN INTERNAL COMBUSTION ENGINE

This invention relates to the process for the production of an idling vaporized mixture to be fed into the inlet manifold of an internal combustion engine; it includes a slow-running jet to be fitted to an auxlilary idling carburettor required for the implementaion of the invention.

It is well-known that in an internal combustion engine the idling speed, when the main butterfly throttle is closed, is normally provided by an auxiliary carburettor fitted with a slow-running jet. For needle valve type jets of existing design, a single chamber is provided to produce the air-fuel mixture.

This type of jet has several disadvantages. Firstly, the mixture produced is not completely homogeneous and results in considerable waste of fuel when the engine is idling. Now, for town driving, consumption at this engine speed greatly influences the average consumption of the vehicle; furthermore, the exhaust gases which are incompletely burned when the engine is idling, represent a serious source of pollution.

Furthermore, known types of slow-running jets with mobile needle-valves close with relative abruptness when the engine speed is increased from idling to a faster rate; this occasionally prevents a smooth increase in speed and may cause the engine to stall.

The object of this invention is to remedy the faults of slow-running jets of known design.

The principal object of the invention is to provide a perfected process for the production of the slow-running vaporized mixture, thus ensuring that this mixture is completely homogeneous.

A further object of the invention is to produce in consequence considerable economies of fuel, particularly when the vehicle is being driven in towns or in built-up areas.

Another object of the invention is to provide a smooth transfer of the engine speed from the idling speed to higher speeds, thus eliminating any risk of stalling the engine.

Finally, this invention is designed to improve a principal vaporized mixture at intermediate or even higher engine speeds in order to improve combustion and permit considerable fuel economy at these engine speeds.

The process forming the subject of this invention is of the type in which a flow of idling fuel $C_r$ is mixed with a flow of idling air $A_r$ in an auxiliary slow-running carburettor; in this invention, the mixture is produced in two phases:

- a premixing phase, carried out in an initial chamber, known as a turbulence chamber, and which consists in mixing the slow-running fuel flow $C_r$ with an auxiliary intake of air $A_a$, smaller than flow $A_r$, in order to obtain a highly vaporized premixture $M_P$ of air and fuel,
- and a final mixing phase, effected in a second chamber known as a mixing chamber, which consists in mixing the premixture $M_p$ with the idling air flow $A_r$.

The most satisfactory premixture $M_p$ is obtained by using an auxiliary air intake $A_a$ of between approximately 2% and 20% of the slow-running air inlet $A_r$.

Experiments have shown that this procedure results in the production of a homogeneous vapour mixture which provides notable fuel consumption economy while the engine is idling.

The homogeneity of the vapour mixture obtained is still further improved in the following manner:

- the auxiliary air $A_a$ and the fuel $C_r$ inlets to the turbulence chamber to form the premixture $M_p$ are positioned approximately at right angles to each other or secant and less than 30° from the perpendicular,
- the premixture $M_p$ outlet from the turbulence chamber is firsly radial and centrifugal at its immediate outlet and is then directed longitudinally towards the mixing chamber,
- the final mixture $M_c$ is formed in the mixing chamber by idling air $A_r$ and the premixture $M_p$ entering the chamber through inlets which are approximatly at right angles or secant and less than 30° from the perpendicular.

A vaporized mixture of exceptional homogeneity is thus obtained, which meets the optimum conditions required to minimize fuel consumption and pollution when the engine is idling.

A further characteristic of this invention is that the premixture $M_p$ is formed by means of a flow of fuel $C_r$ which can be varied in inverse proportion to the engine speed so that it is at its maximum at the idling speed and decreases progressively at intermediate speeds up to its minimum, nil or very low value at high engine speeds.

In this manner, the engine speed increases slowly without risk of stalling; furthermore, by suitably adjusting the minimum value of the flow $C_r$, the operator can—as a function of the type of engine and operating conditions—adjust the richness of the main vapour mixture as it leaves the main carburettor; this mixture can either be enriched by allowing a small additional flow of fuel $C_r$ or by superoxygenating by admitting more air.

The above-mentioned variation in the flow of fuel $C_r$ is obtained by the known effect of vacuum created by the engine, which decreases at the auxiliary slow-running carburettor when the engine speed falls. A further characteristic of this invention is the transmission of this vacuum to the turbulence chamber where it activates a very fine needle valve which can move within a fixed seating and which forms the fuel inlet to the turbulence chamber.

The invention comprises a new slow-running jet designed to be fitted to an auxiliary slow-running carburettor which implements the process defined above. This jet is of a type which includes inlets for idling air $A_r$, outlets for the vaporized mixture $M_c$, inlets for fuel $C_r$, a mixing chamber which communicates with the air inlets $A_r$ and the mixture outlets $M_c$ and a needle valve to adjust the flowrate of the fuel $C_r$.

This jet forming part of this invention comprises:

- a turbulence chamber in which the needle valve is fitted and which, having a fixed seating, communicates with the fuel inlets $C_r$,
- auxiliary air inlets $A_a$ to the turbulence chamber,
- and communication between the turbulence chamber and the mixing chamber.

Figure 2:
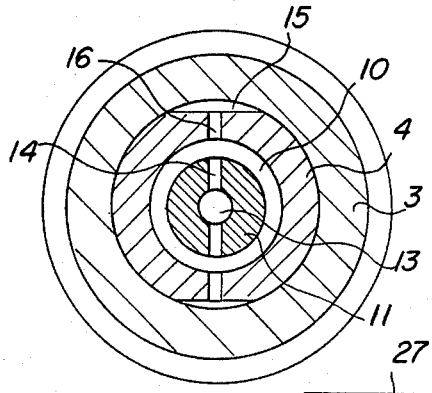
Figure 3:
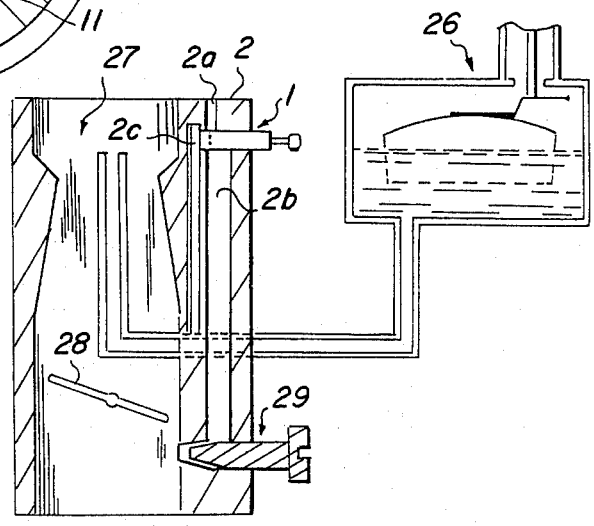
Figure 4:
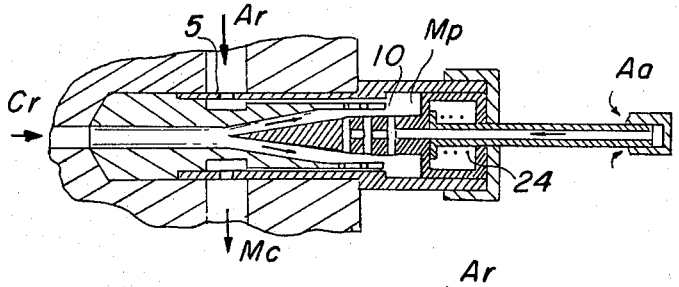
Figure 5:
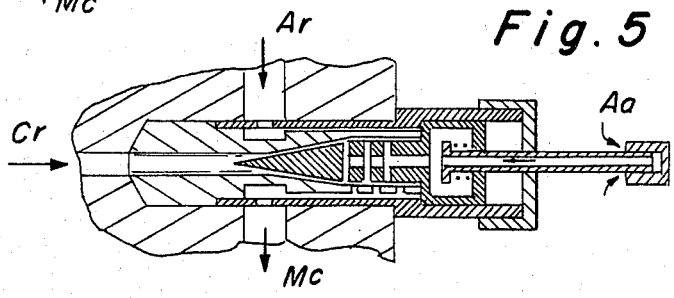

Other characteristics of the invention will be apparent from the description which follows and by referring to the appended drawings which present an example of a preferred, but not limitative design; on these drawings which form an integral part of this description:

FIG. 1 is a cross-section, on an enlarged scale, of a jet which conforms to this invention, fitted in the well of an auxiliary idling carburettor, part of which can be seen in this illustration, FIG. 2 is a transverse section of the jet through the transversal plane AA, FIG. 3 is a diagrammatic view to illustrate the manner in which the jet is assembled in an internal combustion engine unit, FIGS. 4 and 5 are explanatory operating diagrams showing the jet in its slow-running speed position and at a higher speed position respectively.

The slow-running jet 1 shown as an example in the drawings is designed for fitting into an auxiliary slow-running carburettor well which can be seen at 2 in FIGS. 1 and 3. This auxiliary carburettor well incorporates a conventional inlet 2*a* for the idling air $A_r$, with a conduit 2*b* formed in the extension of the former for the outlet of the slow-running vaporized mixture $M_c$ and a conduit 2*c* for distribution of the slow-running fuel. Furthermore, it is drilled with a partially threaded hole in which the jet 1 conforming to the invention is screwed.

The latter comprises a hollow body 3 with an external thread for fitting within the auxiliary carburettor well 1.

This hollow body 3 incorporates a fuel inlet tube 4, one end of which is inserted as a force fit into the former.

The peripheral annular groove of this inlet tube 4 delimits a mixing chamber 5 which communicates firstly with the carburettor conduit 2*a* by a channel 6 for inlet of the air $A_r$, and secondly on the opposite side, with the carburettor conduit 2*b* through a channel 7 for discharge of the vaporized mixture $M_c$, the latter being formed in the slow-running jet.

Furthermore, a fuel inlet channel 8 is drilled axially through the tube 4; this channel communicates with the fuel conduit 2*c* and its other extremity terminates on a tapered seat 9 in a turbulence chamber 10. A mobile needle valve 11 is fitted within this chamber 10, the needle being free to slide with slight friction within the body 3.

In the example shown, this sliding movement is formed by a head 12 which carries the mobile needle valve 11.

At the fixed seating 9, this mobile needle valve 11 is very finely tapered with the angle at the top being approximately between 10° and 30°, and more specifically of the order of 20° to 25°. The seating 9 is of course approximately tapered to fit the needle valve. These units are thus positioned to inject the fuel into the turbulence chamber 10 in a longitudinal direction or less than 30° from the longitudinal line.

Furthermore, the needle valve 11 includes a longitudinal channel 13 for the inlet of auxiliary air $A_a$; this channel is formed along the central line of the former and terminates at right angles in the turbulence chamber 10 by radial channels 14. The auxiliary air leaving channels 14 and the fuel flowing between the needle valve 11 and its seating 9 are thus flowing in directions which are less than 30° from the perpendicular at the point where they contact in the turbulence chamber.

Furthermore, the tube 4 incorporates two diametrically opposed flats which delimit the longitudinal channels 15 between the latter and the body 3: these channels 15 terminate at one end in the mixing chamber 5 and at the other end communicate with the turbulence chamber 10 by radial channels 16 formed around this turbulence chamber.

The premixture $M_p$ formed in the chamber 10, which is subjected to very high turbulence, is thus guided at the outlet from this chamber, first radially in a centrifugal direction in channels 16, and then longitudinally towards the mixing chamber 5.

The premixture flows into this chamber 5 in a longitudinal direction and meets the slow-running air stream which is flowing in a radial direction, the two streams thus contacting at right angles.

Experiments have shown that this appears to be the ideal condition for the formation of a completely uniform and perfectly homogeneous mixture of air and fuel for idling.

Moreover, the auxiliary air $A_a$ is made to flow through channel 13 of the mobile needle valve across a rod 17 which is screwed into a plug 18, itself screwed to the end of the body 2. The rod 17 comprises an axial channel 19 through which flows the auxiliary air; this channel is open at the outer extremity of the rod 17 and is fitted with a cap 20 to adjust the rate of flow of the auxiliary air. This cap incorporates radial apertures 21 which open in line with its threading and the extent to which the said cap is screwed onto the rod 19 thus permits adjustment of the pressure drop, and therefore of the flow of air $A_a$ through the threaded connection between the cap 20 and the rod 19. In other words, the more that the cap is threaded onto the tube, the greater is the resistance to the air flow between the threads. The cap 20 can be held in its selected position by means of a lock-nut 22.

A collar 23 fitted to the rod 19 acts as a thrust seat for a spring 24, the other extremity of which bears against the head 12. This spring therefore repells the head so that the needle valve is held away from its seating 9.

The return force exerted by the spring can be adjusted by screwing the rod 19 in, or out of the plug 18. The rod can be fixed in any determined position by means of a lock-nut 25.

FIG. 3 shows the assembly of the jet forming the subject of the invention; in this figure can be seen the standard units of an internal combustion engine carburettor assembly: the carburettor bowl 26 with its float, the principal carburettor 27, the butterfly throttle 28, the well of the auxiliary carburettor 2 with its mixture adjusting screw 29, the jet 1 as the invention being fitted to this well.

FIG. 4 shows the jet operating when the engine is idling and the butterfly throttle 28 is closed. As the vacuum caused by the engine is insufficient at this speed, the action of the spring 24 lifts the needle valve from its tapered seating. The maximum amount of slow-running fuel $C_r$ is therefore admitted. This flow reaches the turbulence chamber 10 where it meets the stream of auxiliary air $A_a$ flowing at right angles, or almost at right angles, to the stream of fuel.

The flow of this auxiliary air $A_a$ is previously adjusted so that it is less than the slow-running air-flow $A_r$ which enters the well of the slow-running carburettor 2 in a normal manner. For example, good results, in the majority of engines, are obtained when this flow-rate $A_a$ is adjusted to a value representing 4 to 5% of the air-flow $A_r$.

A highly vaporized premixture $M_p$ is thus produced in an initial phase in the turbulence chamber 10, this premixture being then conveyed to the mixing chamber 5 where it is mixed during a second phase with the slow-running air-flow $A_r$. When it leaves this chamber 5, the final vaporized mixture $M_C$ is of exceptional homogeneity before it reaches the engine intake manifold.

As the engine speed rises, the vacuum caused by the engine increases and the mobile highly tapered needle valve gradually falls back to its seating, thus reducing the amount of fuel in the vaporized mixture $M_C$ which nevertheless retains its excellent homogeneity. This very gradual lowering of the richness of the mixture eliminates all traces of rough or uneven operation and thus prevents all risks of stalling at intermediate speeds (up to 2,000 r.p.m. (revolutions per minute) approximately).

The mobile needle valve can be adjusted as shown in FIG. 5 to ensure that the minimum flow of a slow-running fuel is not nil when the engine is running at full speed, which in certain engines enables the amount of fuel in the vaporized mixture formed in the main carburettor to be regulated in particular when decelerating.

It is also possible, in other cases, to close the needle valve completely when the engine is running at high speeds, by allowing it to fall against its tapered seating.

This adjustment of the minimum fuel flow to a low or nil value can be made by means of the head 12 on which the needle valve is mounted; the adjustment is made by changing the position of the head in relation to the needle valve so that, when it is in its forward position, it butts against body 3, thus retaining a minimum gap between the needle valve and its seating or allowing the needle valve to contact its tapered seating.

This invention is not of course restricted to the terms of the above description but includes all variants. In particular, an air filter can be fitted in the auxiliary air $A_a$ inlet tube 17 or at any point in the air flow unit.

We claim:

1. An idling jet for an auxiliary slow-running carburetor comprising a slow-running air inlet ($A_r$), a vaporized mixture outlet ($M_c$), a fuel inlet ($C_r$), a mixing chamber (5) in communication with said air inlet and said mixture outlet, a turbulence chamber (10) having a fixed seat (9) and a movable needle valve (11) positioned in said turbulence chamber (10), said needle and said seat forming a gap of variable cross-section for controlling the axial flow of fuel from said fuel inlet to said turbulence chamber, an auxiliary air inlet (19) for supplying auxiliary air to said turbulence chamber and comprising an axial passage in said needle valve and first radial passages extending radially from said axial passage to said turbulence chamber, second radial passages extending from said turbulence chamber to longitudinal channel means, said longitudinal channel means extending from said second radial passages to said mixing chamber.

2. An idling jet as in claim 1 and wherein said auxiliary air inlet comprises means for adjusting the flow rate of the auxiliary air.

3. An idling jet as in claim 1 or 2 and wherein said needle valve has an angle of its point of about 10° to 30° and includes spring means for urging said needle valve away from said seat.

4. An idling jet as in claim 1 or 2 and wherein said jet comprises an externally threaded hollow body having a slow running air inlet channel and a vaporized mixture outlet channel formed therein, a fuel inlet tube positioned in said body and forming therewith said turbulence chamber, said mixing chamber, and said longitudinal channel means, and further including said seat, and said needle valve being axially slidable in said body.

* * * * *